United States Patent [19]

Muller

[11] 4,204,339

[45] May 27, 1980

[54] TUMBLER WASHING AND DRYING MACHINE

[75] Inventor: Franz Muller, Troisdorf, Fed. Rep. of Germany

[73] Assignee: August Lepper, Maschinen-U. Apparatebau GmbH, Bad Honnef, Fed. Rep. of Germany

[21] Appl. No.: 13,041

[22] Filed: Feb. 21, 1979

[30] Foreign Application Priority Data

Feb. 17, 1978 [DE] Fed. Rep. of Germany ..... 2806873

[51] Int. Cl.[2] ..... F26B 21/08

[52] U.S. Cl. ..... 34/75; 34/77; 68/18 C; 68/20

[58] Field of Search ..... 34/75, 77, 133; 68/18 C, 20

[56] References Cited

U.S. PATENT DOCUMENTS

| | | | |
|---|---|---|---|
| 2,720,037 | 10/1955 | Erickson | 34/75 |
| 2,843,943 | 7/1958 | Geldhof et al. | 34/75 |
| 3,132,005 | 5/1964 | McMillan | 34/75 |
| 4,112,590 | 9/1978 | Muller | 34/75 |
| 4,154,003 | 5/1979 | Muller | 34/75 |

*Primary Examiner*—Larry I. Schwartz

*Attorney, Agent, or Firm*—Cushman, Darby & Cushman

[57] ABSTRACT

An improved cloth-handling machine in which the energy input necessary for evaporating and conducting away water from clothes being dried is minimized. The machine is a tumbler drying or a combination washing/drying machine and includes a casing having a radiant heater disposed adjacent a reflector in its upper portion adapted to heat a tumbler drum rotatably mounted within the casing. Air is withdrawn from the drum and moisture is condensed from the air which is then recirculated back to the interior of the drum. A condenser arrangement, positioned outside the casing, is comprised of an air turbulator portion connected to a drain opening at the bottom of the casing. A spray or mist of cooling water is supplied by way of a nozzle 22 mounted between the turbulator and the drain opening. The turbulator is followed by a filter and a tranquillizing duct leading through a sump to a pump having a syphon-type outlet. From the tranquillizing duct recirculated air is drawn by an impeller and is moved through an air passage between the radiant heater and reflector, so as to be heated and is thence supplied to the interior of the drum by a nozzle projecting through the usual charging opening of the drum.

8 Claims, 1 Drawing Figure

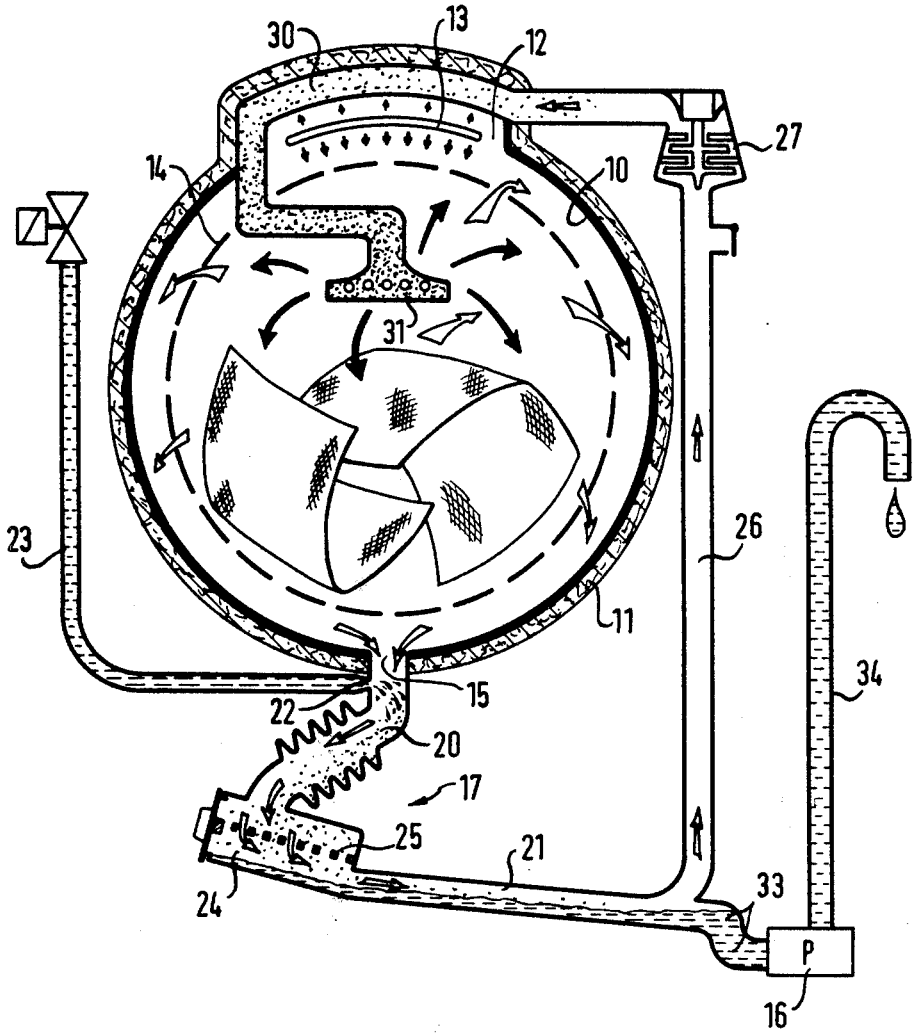
30
13
12
27
14
10
31
23
26
11
34
15
22
20
17
25
21
24
33
P
16

TUMBLER WASHING AND DRYING MACHINE

This invention relates to a drum-type tumbler drying machine which may be only a tumbler drying machine or may also be part of a combination washing and drying machine. Such a combined washer-dryer can be comprised of a casing having a radiant heater disposed in the upper part thereof adjacent a reflector which serves to heat an inner tumbler drum rotatably mounted within the casing in the upper part thereof and adjacent a reflector which serves to heat an inner tumbler drum rotatably mounted within the casing by direct radiation. A recirculated air duct is connected within a drain opening provided at the lower part of the casing and the duct includes a blower. The air duct extends for a large area, over the reflector and opens into a nozzle located within the charging opening of the drum and supplies recirculated air into the interior of the drum. The device also includes a condenser which is supplied with cooling water.

Such a machine is already known, for example as described in U.S. Patent Application Ser. Nos. 697,739 now U.S. Pat. No. 4,154,003 and 731,818 now U.S. Pat. No. 4,112,590. By a combination of individual measures, the recirculated air, which is intended substantially to serve only as a carrier for the moisture and the heat energy necessary for effecting evaporation, is fed as directly as possible to the wet clothes and the tumbling drum, with which the wet clothes are in close contact, is heated directly from its outside by radiant heat. Thus, it has already been possible to achieve a considerable reduction in the water and energy requirements for the drying process, and at the same time it has been possible considerably to shorten the time needed for the drying process.

In the case of this known machine, which is also a washing machine, the inner surface of the casing facing the outer surface of the tumbling drum is used, approximately up to half its overall height, as a condensation surface over which the supplied cooling water flows as a comparatively thin film to the drain opening at the lower part of the casing. Although, as a result of the positive recirculated air guidance achieved in this machine, the moisture-laden air flows along between the drum and the condensation surfaces and releases its moisture, and a relatively high condensation performance is achieved. It has however proved to be disadvantageous, so far as concerns energy consumption, that the condensation surface lies directly opposite the drum heated by radiation. As a result of this arrangement, a proportion of the heat energy fed to the washing drum is given off, by radiation, directly to the condensation surface and is therefore not available for the evaporation of moisture in the wet clothes.

Also, the use of the inside of the casing as a condensation surface over which the cooling water flows substantially as a closed water layer during the entire drying process results in relatively high water consumption. The amount of cooling water supplied is considerably greater than that which is necessary for the precipitation of liquid from the moisture-laden recirculated air.

The problem underlying the invention is to provide, for a tumbler drying machine of the kind referred to above, measures by which the water and energy consumption is further reduced by better utilization of the supplied heat energy and of the supplied cooling water, yet involving no extension of the drying time, and if possible achieving a further shortening of the drying time. As a result of these measures, the aim is intended to improve the consumption of cooling water and energy each by at least up to 10% relative to the comparable consumptions of the known machine.

This problem is solved, in the drum-type drying machine before, in accordance with the invention in that, for exhausting moisture-laden recirculated air, the recirculated air duct is connected to the drain opening by way of a condenser arrangement comprising a tubulator followed by a tranquillizing duct. A spray nozzle for supplying cooling water connects with the tubulator to form a water spray or mist therein, and the tranquillizing duct extends at a slight downward inclination and is connected, by way of a drainage sump which lies at a lower level than the tranquillizing duct, to a waste water pump. Further, the recirculated air duct connects with the tranquillizing duct at or adjacent the lower end thereof and in advance of the drainage sump.

With the drying machine designed in this way, one achieves the advantage that the drum, heated by direct radiation, suffers considerably less energy loss by radiation in the outward direction towards the casing so that more energy is available for evaporation of moisture present in the wet clothes. Since the condenser is located outside the casing and the moisture-laden air is exhausted through a water spray or mist and is set into turbulence therewith, a very intensive cooling down of the recirculated air is obtained. Also, because this air comes into contact with the cooling water over a very large arc as a result of the turbulence, considerably less cooling water is needed for precipitation of the water from the recirculated air. The tranquillizing duct connected subsequent to the turbulator ensures that water particles entrained in the air stream are precipitated from this stream so that the recirculated air aspirated by the impeller is practically free from water particles.

A development of the invention provides for the turbulator to be formed at least partly by a corrugated tube. This corrugated tube has two advantages. First, the recirculated air negotiating the convolutions of the corrugated tube is set into turbulence, whereby particles of water collecting from the water spray or mist on the wall of the turbulator are successively separated from the turbulator's surface and are set into turbulence with the recirculated air. As a result there is a very intensive mixing of the recirculated air with the cooling water, so that the recirculated air can give off its moisture in an optimum manner. Secondly, a flexible coupling is achieved between the drain opening and the condenser arrangement.

It is advantageous to arrange the tranquillizing duct so that it extends at an angle, preferably less than 90°, relative to the turbulator portion. This is because tranquillization of flow and, at the same time, effective precipitation of the water occurs at the area where the angle is located due to the different forces arising from inertia so that complete separation of the water and the air occurs in the downstream tranquillization duct. By commingling of the cooling water and the recirculated air on the one hand, and by tranquillizing and precipitating the cooling water from the recirculated air on the other hand, a further improvement emerges if a filter chamber is interposed between the turbulator and the tranquillizing duct of the drain passage. This filter chamber preferably has a cross section which is relatively large in comparison with the cross section of the tranquillizing duct, and is preferably subdivided by a filter positioned therein. This arrangement serves to provide for renewed turbulence of cooling water and recirculated air, as it passes through the filter after which, as a result of relaxation, calming occurs, which calming contributes to the precipitation of the water from the recirculated air. For this reason that portion of the filter chamber which lies under the filter is advantageously designed as a collector for the cooling water and condensate.

The tranquillizing duct is preferably tubular in form and has a cross section which is smaller than that of the turbulator. This reduction in the cross section of the tranquillizing duct is possible on account of the comparatively laminar flow of the recirculated air and of the cooling water in this region. This shape and size is also advantageous since the volume or space to be filled several times with water for the washing process can be kept smaller, which contributes to a reduction in the water requirement. Also contributing to reduction in the water requirement is the use of the drainage sump between the tranquillizing duct and the waste water pump. This drainage sump not only ensures that the water level necessary for the operation of the waste water pump is present, but also makes it possible to keep the overall volume of the condenser arrangement as small as possible, whereby the water requirement can be further reduced. Where the machine is also a washing machine the entire system has to be filled with water and emptied several times during the individual washing and rinsing steps, so that the volume content of the condenser arrangement has a significant effect.

The heat balance and energy utilization in this device is also greatly improved by use of a heat insulation layer on the outside of the casing, which layer, as can easily be appreciated, reduces loss of the heat energy supplied for water evaporation in the interior of the casing.

The invention will be described further, by way of example with reference to the accompanying drawing in which the single FIGURE is a schematic elevation of the preferred embodiment of the drying machine in accordance with the invention.

The essential parts of the preferred embodiment of the drum-type washing and tumbler drying machine according to the present invention are shown schematically in the drawing, in which the exterior housing of the machine is emitted. A washing liquid container or casing 10 is provided, on its outside, with a heat insulation layer 11 and is shaped in its upper part with a bulge 12 which extends over the entire axial length of the casing 10 and in which a radiant heater 13 is installed. This heater 13 serves to effect heating by direct radiation of the tumbler drum 14 rotatably mounted in the casing 10, the inner surface of the bulge 12 of the casing 10 serving a reflector. As a result of the presence of this reflector, the radiant heat emitted towards the tumbler drum 14 is increased. The material of the drum 14 is a good thermal conductor and transfers the absorbed heat energy to clothing or other material present in the interior of said drum 14. The drum 14 can be blackened on its outside.

Situated in the base of the casing 10 is a drain opening 15, via which the washing liquid and rinsing water can be conducted away drying operation of the machine for washing, with the aid of a pump 16.

Connected to the drain opening 15 is a conductor arrangement generally indicated at 17, which is comprised of a tubulator portion 20 and a tranquillizing duct 21. The turbulator portion 20 is preferably comprised of a corrugated tube which extends at an angle obliquely downwards and away from drain opening 15. A spray nozzle 22 is provided in the conductor arrangement 17 between drain opening 15 and the turbulator portion 20. Cooling water is supplied to nozzle 22 by line 23 and when this occurs a water spray or mist is produced in turbulator portion 20.

The tranquillizing duct 21 of the condenser arrangement 17 comprises a tube which is preferably straight, but which extends downwards at a slight incline, and at an angle of somewhat less than 90° relative to the turbulator 20. This ensures that there is a flow deflection or change of direction from the turbulator portion 20 to the tranquillizing duct 21.

Interposed between the turbulator and the tranquillizing duct is a filter chamber 24, which serves, of course, to arrest yarns, fluff, lint or other loose matter, and which preferably has a larger cross section than the corrugated tube of the turbulator and the tube of the tranquillizer duct. Extending transversely through the filter chamber is a removable filter screen 25. This filter screen 25 subdivides the chamber 24 into upper and lower regions.

The lower end of the tranquillizing duct 21 connects with a recirculating air duct 26 which leads upwardly to an impeller or suction pressure turbine 27. From this impeller 27 an air passage 30 extends to a fan-type nozzle 31 which is arranged in the front end wall of the casing 10 in such a way that the recirculated air is injected thereby into the interior of the tumbler drum 14 under positive pressure through the upper portion of the usual front charging aperture of the tumbler drum 14. In the region above the reflector, between drum 14 and radiator 13, air passage 30 is designed to extend over a substantial area so that air moving therethrough can absorb heat energy given off from the reverse side of the radiator. This air passage 30 has a comparatively low height, over the entire bulge 12, so that the cross section of the air stream is thus relative to its width.

The recirculated air flowing through the air passage 30 absorbs a significant proportion of the upwardly-directed heat from the radiator, which heat would otherwise be lost, so that the recirculated air becomes more receptive to water vapor.

The tranquillizing duct 21 of the condenser arrangement 17 is connected by way of a drainage sump 33 to a waste water pump 16. This drainage sump 33 comprises a portion of tube which is angled off downwardly in syphon-like manner and which ensures that the water running thereto collects in the comparatively small volume of the drainage sump 33 in front of the pump 16 and ensures that a water level therein is always above the level of the pump, so that the pump always has liquid to draw on. As a result of the presence of the drainage sump 33, which lies lower than the tranquillizing duct 21, the cross section of the tranquillizing duct 21 can be kept comparatively small, so that only a slight amount of water is necessary in order to ensure the full operability of pump 16. This also lowers the overall volume of the condenser arrangement 17 and reduces the overall water requirement to a minimum. Also contributing to this purpose is the omission of any waste water sump in the vicinity of the drain opening 15, which is reduced to the smallest possible cross section necessary for optimum exhaustion operation, to which the cross section of the turbulator is also adapted.

An outlet 34 for waste water is connected to the pump 16.

The advantageous operation of this device occurs since the casing 10, with its heat insulation 11, is usable optimally as a steam producer and thus requires considerably less heat energy for the evaporation of liquid contained in the wet material than in prior devices. Since condensation takes place outside the casing, none of the heat energy, fed for the evaporation of the liquid in the casing is lost by radiation losses to the condenser.

Further, the condenser arrangement can precipitate moisture from the recirculated air using only a minimum amount of cooling water, since the recirculated air exhausted through drain opening 15 commingles intensively with the water spray or mist in the turbulator 20 and very rapidly gives off its condensation heat and, therewith, moisture to the individual droplets forming the water spray or mist. As a result of the interposition of the corrugated tube, the cooling water collecting on the tube wall and flowing away via the corrugated tube, is caused to swivel and separate from the wall surface again and again in the region of the corrugated tube by the air stream flowing by and is therefore subjected to considerable turbulence. Since the proportion of the recirculated air is relatively great in comparison, with the amount of cooling water, and the recirculated air flows in the turbulator at a comparatively great velocity, the turbulence and commingling of the recirculated air with the water spray or mist continues right into the filter chamber where it experiences a slight initial tranquillization. Upon flowing through the filter screen, a nozzle effect occurs, so that in the region of the filter, renewed commingling between air and water takes place. Only underneath the filter screen does the water precipitate or become separated from the air in the quiescent space present thereunder and by virtue of the relaxation which occurs in the recirculated air flow below the filter screen.

The waste water collecting the filter chamber 24 flows away via the tranquillizing duct 21, under the influence of gravity, towards the drainage sump 33. Since the tranquillizing duct 21 is relatively long and tubular, the water separates from the recirculated air stream and flows on the bottom surface of duct 21 to drainage sump 33. The recirculated air flow which is largely laminar in the tranquillizing duct, does not have any tendency to reentrain into the air stream once again as droplets of water. On the contrary, it can be observed that the air stream forces the water against the lower surface of the duct and a uniformly calm and quiescent flow of the water is achieved.

It has become apparent that, in the case of a continuously-running recirculated air stream, continuous injection of cooling water into the turbulator is not necessary. This is attributed to the fact that the cooling water collects in the convolutions of the corrugated tube and open overflowing into the next tube is entrained by the recirculated air current flowing by and is again subjected to turbulence. In this way a water spray or mist can be maintained for a period longer than the time interval during which cooling water is injected. In the meantime, water which has collected in the drainage sump 33 is pumped away, so that there is no danger of a backwash of water in the tubular tranquillizing duct 21.

Tests with a combined drum-type washing and tumbler drying machine equipped in accordance with the invention have shown that in relation to water consumption and power consumption, savings of the order of magnitude of more than 10 percent relative to the most economical currently known machines can be achieved.

It will be understood that while the illustrated embodiment has been described as being a tumbler dryer, the invention is equally applicable to combined washing machines and tumbler dryers, and machines which are solely tumbler dryers.

While the invention has been described in connection with what is presently conceived to be the most practical and preferred embodiment, it is to be understood that the invention is not to be limited to the disclosed embodiment but on the contrary, is intended to cover various modifications and equivalent arrangements included within the spirit and scope of the appended claims, which scope is to be accorded the broadest interpretation of such claims so as to encompass all such equivalent structures.

What is claimed is:

1. A drum-type tumbler drying machine comprising a casing having an upper and lower part, a tumbler drum rotatably mounted within said casing, a radiant heater mounted in the upper part of said casing, said heater including a reflector which serves to effect direct radiation of said tumbler drum, a recirculated air duct which connects with a drain opening at the lower part of the casing and includes an impeller, said air duct extending over the reflector and opening into a nozzle positioned in the charging opening of said drum so that said nozzle supplies recirculated air into the interior of the drum, said air duct further including a condenser supplied with cooling water, said recirculated air duct being connected to said drain opening by way of said condenser, said condenser comprising turbulation means for creating an area of turbulent air flow, a tranquillizing duct located downstream from said turbulation means, spray means positioned upstream from said turbulation means for supplying cooling water, said tranquillizing duct extending at a slight downward inclination with respect to said turbulation means, said tranquillizing duct further including a drainage sump located at a lower level than said tranquillizing duct, a waste water pump and a recirculating air duct for carrying recirculating air to said impeller, said recirculating air duct being connected to said tranquillizing duct at or adjacent the lower end thereof and in advance of the drainage sump.

2. A machine as in claim 1 wherein said turbulation means is formed at least partly by a corrugated tube.

3. A machine as in claim 1 or 2 wherein the tranquillizing duct extends at an angle of less than 90° relative to said turbulation means.

4. A machine as in claim 1, 2 or 3 wherein a filter chamber is interposed between said turbulation means and said tranquillizing duct.

5. A machine as in claim 4 wherein a part of said filter chamber which lies under a filter collects cooling water and condensate.

6. A machine as in claim 1 wherein the tranquillizing duct has a tubular cross section which is smaller than that of said turbulation means.

7. A machine as in claim 1 wherein said casing is provided with a heat insulating outer layer and the outer surface of said tumbler drum is black.

8. A drying machine as in claim 1 wherein the cooling water is introduced at intervals in to said turbulation means.

* * * * *